United States Patent [19]

Larsson

[11] 4,106,149

[45] Aug. 15, 1978

[54] INFLATABLE FLOATING BRIDGE, LAID OUT BY INFLATING LONGITUDINAL HOSES IN THE BRIDGE

[75] Inventor: Erik Johan Larsson, Gamleby, Sweden

[73] Assignee: Barracudaverken AB, Sweden

[21] Appl. No.: 804,470

[22] Filed: Jun. 7, 1977

[30] Foreign Application Priority Data

Jun. 18, 1976 [SE] Sweden ..... 7607048

[51] Int. Cl.[2] ..... E01D 15/14

[52] U.S. Cl. ..... 14/27

[58] Field of Search ..... 14/27, 2.6, 1

[56] References Cited

U.S. PATENT DOCUMENTS

| | | | |
|---|---|---|---|
| 3,252,173 | 5/1966 | Robinsky | 14/1 X |
| 3,258,800 | 7/1966 | Robinsky | 14/1 X |
| 3,466,685 | 9/1969 | Robinsky | 14/27 |
| 3,496,586 | 2/1970 | Kaufman | 14/27 |
| 3,999,879 | 12/1976 | Stachiw | 14/27 X |

FOREIGN PATENT DOCUMENTS

| | | | |
|---|---|---|---|
| 123,043 | 5/1900 | Fed. Rep. of Germany | 14/27 |
| 133,746 | 5/1941 | Sweden | 14/27 |

*Primary Examiner*—Nile C. Byers

*Attorney, Agent, or Firm*—Roylance, Abrams, Berdo & Farley

[57] ABSTRACT

An inflatable floating bridge which can be rolled up or folded up when it is not inflated. The bridge comprises two spaced-apart inflatable air hoses at the sides of the bridge, the inflation of these air hoses by means of pressurized air resulting in the laying out of the bridge. When said hoses have been inflated, and the bridge thus has been rolled out, they constitute the buoyant longitudinal side supporting means of the bridge. Between said hoses there is provided a sheet constituting the bridgeway and having its longitudinal sides fluid-tight joined to one of each hose. On the sheet there are also provided load distributing means and spacing means for the distribution of load and for the spacing-apart of the hoses.

13 Claims, 6 Drawing Figures

INFLATABLE FLOATING BRIDGE, LAID OUT BY INFLATING LONGITUDINAL HOSES IN THE BRIDGE

The present invention relates to an inflatable floating bridge, which can be rolled or folded up when it is not inflated.

In catastrophies, occasional work and in war, there is a specified need of the availability of easily transportable bridges, which can be quickly moved to sites of immediate interest for preparation or erection.

The Swedish Pat. No. 133,476 teaches a bridge-like construction with a flexible inherently buoyant way, for carrying items such as vehicles on water. The known construction is however heavy, voluminous in transport and expensive to manufacture and cannot be quickly moved to and erected at sites of immediate interest.

However, the floating bridge according to the invention satisfies the requirements set forth above in all respects.

According to the invention, this is enabled by the inflatable floating bridge being characterized by at least two inflatable hoses, arranged side by side and at a specific distance from each other, their inflation resulting in laying out of the bridge, said hoses in an inflated condition constituting the buoyant longitudinal side supporting means of the bridge, between said hoses there being arranged a sheet constituting a bridgeway, each side edge portion of the sheet being fluid-tight joined to one of the hoses; by at least partially elastic load distributing means being arranged on the sheet, whereof at least some are connected to the hoses for load transmission; by spacing means separating the hoses; and by displacement increasing means.

Apart from being anchored to land and used as a floating bridge, the inflatable floating bridge according to the invention can alternatively be used as a floating transport unit, for example a barge.

So that the sheet constituting the bridgeway will not form a "sack" when it is subjected to local loading, the sheet is provided with said load distributing means which, in coaction with the inflatable hoses, distribute the load in question over a greater area. Since the load distributing means are at least partially elastic, an extended but moderate local downward curvature of the sheet is obtained as a result of the load in question. The displacement of this downward curvature gives the bridge a considerable part of its carrying capacity.

To enable rolling up the bridge for storage and transport, the load distributing means must be so made that they do not prevent rolling up.

This is accomplished according to the invention by having the load distributing means comprise a plurality of mutually separated elongate load distributing elements attached to the bridgeway sheet, the elements being arranged transversely over the bridgeway and are preferably uniformly distributed along the length of the bridgeway. These load distributing elements can, for example, have the form of rods, pipes, fillets, or ribs. The load distributing elements are attached to the sheet at such mutual spacing that they do not prevent rolling out the sheet when the floating bridge is laid out by inflating the hoses. The stiffness in the longitudinal direction of the bridgeway, required for load distribution, is obtained by a suitable excess pressure in the hoses and by at least certain of the load distributing elements being arranged to transfer load to the hoses. It is hereby also suitable that at least certain of the load distributing means also form the spacing means between the hoses. These spacing means keep the hoses definitely spaced during transport as well as use. It must naturally be arranged hereby that the load distributing elements are so formed that injuriously large stresses do not occur in the sheet or the hoses.

For achieving this, it is suitable that the load distributing elements are shorter than the distance between the longitudinal joining lines between the bridgeway sheet and the hoses, certain of the elements being displaced towards one side of the bridge and suitably placed with one end relatively close to one joining line, while other elements are displaced in a corresponding manner towards the other side of the bridge. Thus, for example, alternate load distributing elements can be displaced towards one side, while the remaining elements are displaced towards the other side of the bridge. When such a load distributing element is subjected to load, the other end of the element lying at a distance from a hose can then press down the sheet and cause a local supporting displacement, which reduces the stress on the attachment of the distributing element close to the other hose.

In an alternative embodiment, the load distributing elements are only somewhat shorter than the distance between the longitudinal joining lines between the bridgeway sheet and the hoses, whereat the end portions of the elements are made weaker than the rest of the element. Here, the load distributing elements have been given such a length that they almost reach right up to the hoses at both ends, the elasticity of the element being so chosen in relation to expected load that the deflection causes sufficient reduction of pressure of the ends on the sheet.

The load distributing elements, for example formed as rods, pipes, fillets or ribs, suitably consist of material which, while it is stiff against bending, is flexible or elastic to a certain extent, for example timber, glass fibre, reinforced plastic etc. It is further suitable for the outer ends of the load distributing elements to be provided with surface increasing means, for example plates, having a considerably larger maximum dimension (for example diameter) than the width of the element. The ends of the load distributing elements can also be rounded off and possibly provided with a protective coating which lessens the local stress on the sheet and wear against it. The outer ends of the distributing elements can also be formed as semi-hard plates with rounded edges, for example plastic discs with a diameter which is about three times greater than the width of the element.

As is apparent from what has been said hereinbefore, the displacement increasing means can thus suitably comprise elastic end portions of the load distributing means, and the portions of the bridgeway sheet adjacent to the end portions.

Particularly when using long pneumatic bridges of light construction, there is a risk that the bridge will ease from the surface of the water and "capsize" in a strong wind. The risk of such capsizing can however be suitably decreased by providing the bridge with one or more longitudinal ballast hoses which can be filled with water. For example, if two such ballast hoses are used, these can be arranged on the bridgeway sheet closely adjacent the side supporting means made as hoses. Alternatively, the water-fillable ballast hoses can be arranged inside the side supporting means made as hoses.

If the water in these ballast hoses is put under a certain pressure, they can also contribute to the mechanical stiffness of the entire bridge construction.

The side supporting means made as hoses and/or the bridgeway sheet suitably consist of an elastic material provided with reinforcing, for example reinforced soft plastic sheet or rubber sheet. The supporting hoses as well as the ballast hoses are preferably made by welding such reinforced sheet. In many cases it is suitable that each of the side supporting means made as a hose and at least a contiguous portion of the bridgeway constitute a part of the same piece of sheet, of which a rolled-in edge portion forms the respective hose and is sealingly united, for example welded, to the piece along the longitudinal joining line between the bridgeway and the respective hose. The whole bridge can hereby be made starting from two pieces of sheet, which are united to each other by means of a longitudinal joint approximately at the middle of the bridgeway. It is also quite possible for the supporting hose and the whole of the bridgeway to be produced from a single piece of sheet.

In order to obtain satisfactory strength against pressure it is essential that all joints are formed so as to avoid stripping forces, that is they are not liable to "peel," but are mainly affected by shearing forces.

Since it is both difficult and expensive to produce entirely pressure-tight sheets, it may be preferred in many cases to accommodate inner tubes of gas-tight material, for example rubber or unreinforced plastic in the side carrying means made as hoses.

A problem, which may possibly arise when inflating and laying out (rolling out) a floating bridge according to the invention on a water surface, is that water can get into the crease between both the carrying hoses and the roll, which will lie partly submerged in the water because of its weight. This problem can, for example, be eliminated by having the roller braked during rolling out, so that the carrying hoses have time to be inflated to full diameter right up to the roll the whole time.

According to the invention it is therefore suitable that the rolling-out end of the bridge is provided with guiding means, for example guide lines, rudder, fins or the like whereby rowing out onto the water can be controlled. A simple solution hereby is that the floating bridge is rolled up around a shaft (at the rolling-out end of the bridge), it being possible to control the movement of the shaft from land with the aid of ropes connected to it. Such a shaft is moreover desirable and suitable for enabling easy handling of the rolled-up floating bridge.

With the help of the ropes extending to said shaft, it will also be possible to direct the outer end (rolling-out end) of the bridge from land, which can be desirable, especially when rolling out in moving water or under windy conditions. The shaft can also constitute a fixing for rudders or fins, which hang down into the water and lessen the drift due to wind during rolling out.

To prevent inflow of water onto the bridgeway from the bridge end when the bridge is completely blown up and rolled out, it is suitable for the rolling-out end of the bridge to be provided with an end termination upstanding over the plane of the bridgeway. Such an end termination can be provided, for example, by the end terminating plugs of both the supporting hoses being connected by ropes to points a distance in on the supporting hoses. When rolling out is completed, there is thus formed a fold on the hoses, and the outer ends are lifted up out of the water together with the portion of the bridgeway sheet between the ends, whereby inflow of water from the bridge end is prevented. Other ways of providing the desired end termination of the bridge are also conceivable. It is thus conceivable that the transport and guiding shaft at the centre of the roll, mentioned hereinbefore, is attached to the upper sides of the end plugs by means of bearing fittings, and is used as support for lifting up the edge of the bridgeway sheet, for example by means of loosely running metal rings, so that the sheet edge hereby forms a shield against inflow. It is also possible to couple the end plugs together with each other and with the sheet so that the hoses fold inwards in the horizontal plane. Inflow of water onto the bridgeway from the bridge end can also be prevented with the help of a rib or the like, welded into the end edge of the sheet, the ends of the rib being attached to the upper sides of the supporting hoses to form a gunwale-like end termination.

As mentioned hereinbefore, the inflatable floating bridge according to the invention does not necessarily need to be stored rolled up when it is not used (when it is not inflated), and the bridge can just as well be folded zigzag, that is by folds one on top of the other to form a compact packet, whereby space can be saved. When the bridge is packed in this way, and in other cases as well, it can be suitable to arrange for the compressed air filling of the inflatable hoses of the bridge to take place from the "outer end" of the bridge, using hoses which may possibly pass through the supporting hoses, or by having the air filling unit accompany the outer end of the bridge when this is pushed out fold after fold onto the water surface. It should be possible to achieve the same effect with a cord introduced into the supporting hoses, to engender a channel for air in spite of the folds.

If a flotating bridge is used, which in inflated laid-out condition is longer than the stretch of water over which it is laid out, the parts of the ends of the bridges which will then lie on land may be used as a kind of ladder or steps when the "shores" in question slope more or less heavily. For example, it is conceivable for the bridge to be inflated from one side of a ravine, to roll out over the water to the opposite side and there "climb up" a corresponding ravine wall or slope. It could be necessary here to anchor the bridge at both its ends, in some cases.

The invention will now be described further, and exemplified by referring to some of its embodiments which are shown on the appended drawing. On the drawing, FIG. 1 shows in perspective a rolled-up floating bridge, according to the invention, on the shore ready for rolling out with the help of air from compressed air cylinders connected to the ends of the inflatable hoses by means of filling hoses;

Figure 1:
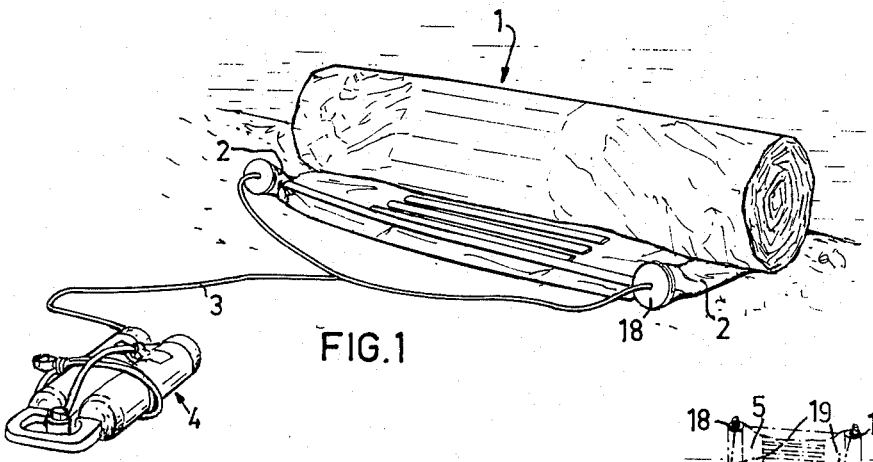

In FIG. 1 there is shown a rolled-up inflatable floating bridge 1 according to the invention. The rolled-up floating bridge is shown placed on a shore contiguous to the water line. A compressed air line 3, with which compressed air can be supplied from a compressed air supply 4 provided with a regulating valve, is connected to the ends of the longitudinal side supporting means 2 of the floating bridge, consisting of two inflatable hoses. So that the consumption of compressed air when inflating the floating bridge will not be unnecessarily great, it can be suitable, at least during the first phase of filling the bridge with air, to use a jet pump or injector (not shown), which contributes to reducing the consumption of compressed air.

Figure 2:
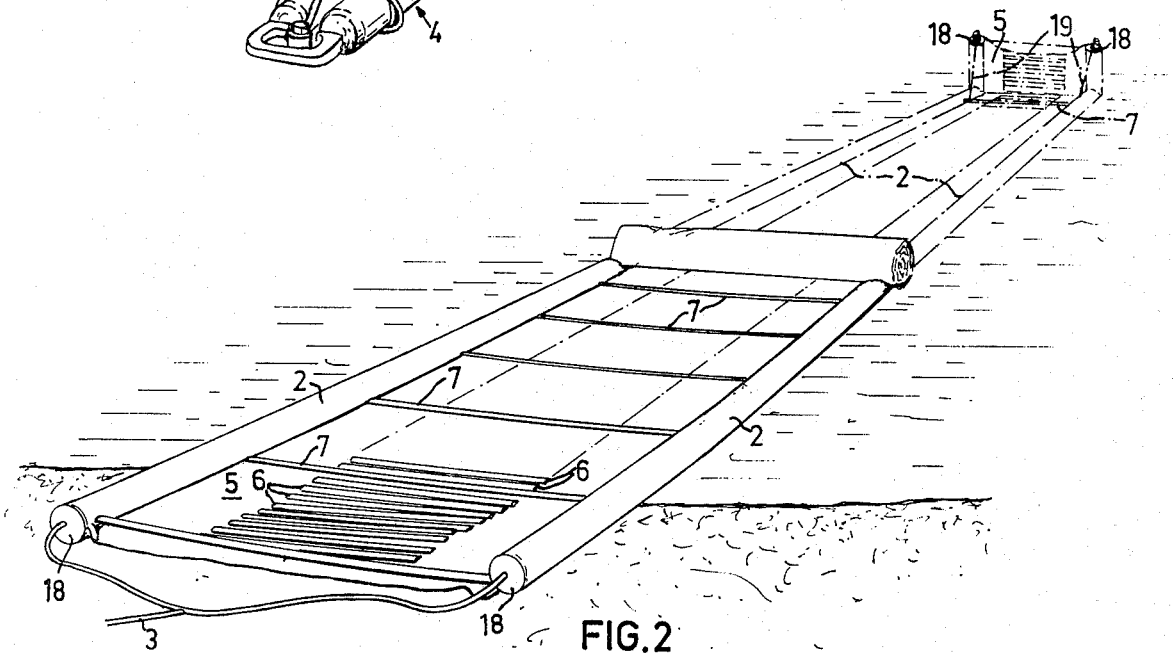
FIG. 2 shows the bridge of FIG. 1, rolled approximately halfway out, the rest of the bridge being shown in the completely rolled-out position by means of chain-dotted lines.

In FIG. 2 showing the floating bridge 1 inflated and rolled out to approximately half its length, the inflated hoses 2 of the bridge are clearly seen floating on the water, with the sheet 5 constituting the bridgeway extending between the hoses. As may be seen, the hoses 2 are mutually spaced and extend substantially parallel to each other. The inflated hoses 2, which thus constitute the longitudinal side supporting means of the bridge, are joined fluid-tight to the side edge portions of the sheet 5. On the sheet 5, forming the bridgeway, there are arranged transverse to the length of the bridge a plurality of mutually parallel load distributing elements 6, 7, consisting of comparatively stiff but also elastic strips or ribs. As may be seen, the load distributing elements 7 extend almost up to the supporting hoses 2, while the load distributing elements 6 finish at a distance from the supporting hoses 2. It is thus primarily the elements 7 together with adjacent portions of the sheet 5 which transfer the load which can arise on the bridge to the hoses 2. The elements 7, formed as flat strips, also constitute spacer means between the supporting hoses 2. Outside the not yet rolled out outer portion of the floating bridge, it has been shown with chain-dotted contours how the bridge can appear in a completely inflated and rolled-out condition.

Figure 3:
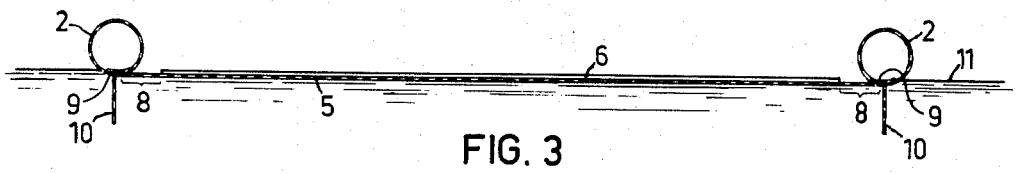
FIG. 3 shows in cross-section a principle embodiment of the bridge in an unloaded condition.
Figure 4:
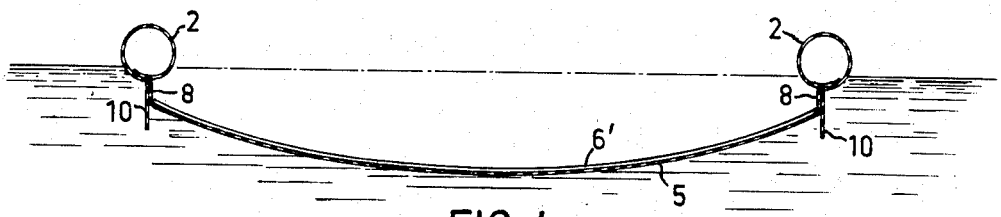
FIG. 4 shows in cross-section the bridge according to FIG. 3 in a loaded condition.

Turning now to FIGS. 3 and 4 for clarification of the principle construction of the inflatable floating bridge, it will be seen that these figures show a principle embodiment of the floating bridge seen in cross-section, in an unloaded condition in FIG. 3 and in a loaded condition in FIG. 4.

In the unloaded state of the bridge, it will be seen that the sheet 5 extends substantially horizontally between the air-filled supporting hoses 2 along the sides of the bridge. On the upper side of the sheet there are attached to load distributing ribs 6'. In FIGS. 3 and 4, the numeral 8 denotes the edge portions of the sheet which lie between the outer ends of the ribs 6' and the longitudinal joining lines 9 between the bridgeway sheet 5 and the hoses 2. Although the load distributing elements made as ribs 6' are shorter than the distance between the longitudinal joining lines 9, there is nothing to prevent certain of the ribs, in the same way as the ribs 7 according to FIG. 2, extending to the areas closely adjacent the hoses 2. It is also conceivable that certain of the load distributing elements, for example alternate elements, are displaced towards one side of the bridge, while the remaining elements are displaced towards the other side of the bridge in a way apparent from FIG. 5, in which said load distributing ribs are denoted by 6''.

In FIG. 3 the numeral 10 denotes strips of heavy-made sheets (sheets with a density greater than 1.0) dependent from the underside of the supporting hoses 2 in the water, to prevent wind coming in under the bridge and thereby possibly enabling it to lift and, in the worst case, capsize the bridge.

Although it is not more clearly apparent from FIGS. 3 and 4, the supporting hoses 2 are in practice made as outside hoses of reinforced plastic in which there are accommodated inner hoses of rubber or unreinforced plastic.

Considering now FIG. 4, which shows the bridge in a loaded condition, wherein the sheet 5 and the ribs 6' have been pressed down under the level of the water surface 11 outside the supporting hose 2. The displacement of water provided by pressing down the sheet 5, together with the lifting force from the hoses 2 gives the bridge the required carrying capacity.

From FIG. 4 it is clear that the sheet portions 8 are essential when it is a question of providing the increased displacement which gives lifting force.

Figure 5:
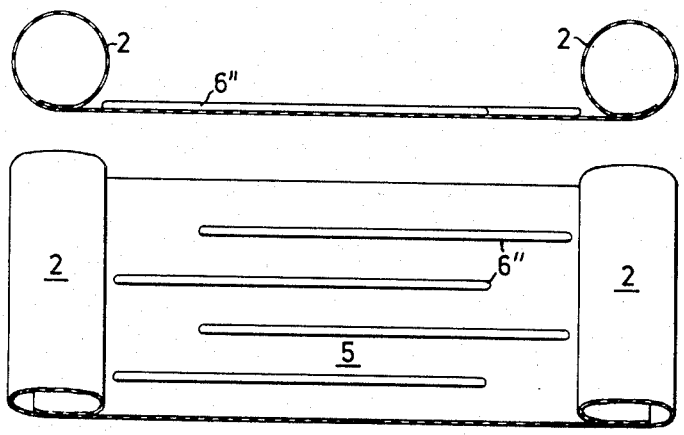
FIG. 5 shows in cross-section and plan view a portion of another principle embodiment of the bridge; and, finally.

In FIG. 5, as already mentioned above, there is shown a section of an embodiment of the floating bridge in which the ribs 6'' are alternately displaced towards the sides of the bridge so that their outer ends are comparatively close to the supporting hoses 2. By such placing of the load distributing elements 6'', a large local depression of the sheet is avoided which might be the result if the bridgeway shown in FIG. 2 is loaded close to the hoses 2. In the embodiment shown in FIG. 5 it is further apparent that the load distributing elements 6'', shaped as strips, together with intermediate portions of the sheet 5 also constitute spacing means between the hoses 2.

Figure 6:
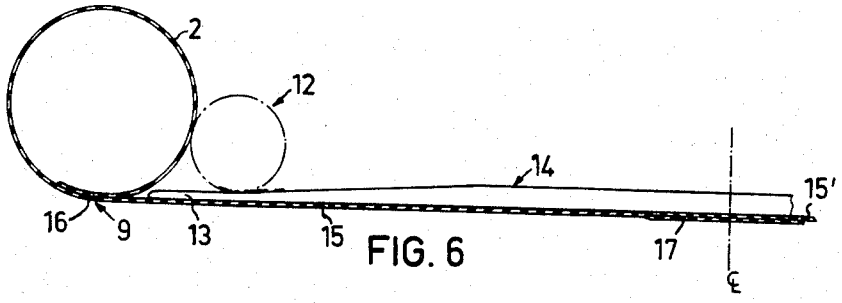
FIG. 6 shows in cross-section one half of a bridge, to each of the inflatable hoses of which there is arranged a ballast hose.

In FIG. 6 there is shown in cross-section a further embodiment of the floating bridge according to the invention, although only the left-hand half of the bridge is shown. In the embodiment shown there are arranged displacement increasing means in the shape of longitudinal ballast hoses 12, fillable with water, arranged adjacent the supporting hoses 2 and on the outer, thinner end portions 13 of the load distributing means 14. Alternatively, it is conceivable that the water-fillable ballast hoses 12 are arranged inside the side supporting means 2, made as hoses. The ballast hoses 12 could also be attached to the underside of the supporting hoses 2 and extend along them.

In FIG. 6 it is further shown how one of the supporting hoses 2 of the bridge and the adjacent half of the bridgeway can constitute portions of one and the same piece of sheet 15, which at 16 is welded to itself to form the supporting hose 2 and at 17 (along the centreline CL of the bridgeway) is welded to a corresponding piece of sheet 15; forming the other bridgeway half and the other supporting hose 2. It is also quite possible to make the whole of the bridge construction from a single piece of sheet, whereby the pieces 15 and 15' according to FIG. 6 would constitute the left and right half, respectively, of a single piece of sheet. In such a case the longitudinal weld 17 in the middle of the bridgeway is completely avoided.

To prevent inflow of water on the upper side of the bridgeway from its end, when the floating bridge is completely rolled out, it is suitable to have at one or both ends of the floating bridge some kind of end termination which functions as a kind of wall in the same way as the remaining parts of the supporting hoses 2. As indicated by the chain-dotted contours in FIG. 2 such an end termination can have the form of an upturned end portion of the bridgeway sheet 5. This upturned end portion can be provided simply by the end terminations 18 in the ends of the supporting hoses 2 being anchored to points lying a distance in from the ends of the supporting hoses 2 by means of ropes or cables 19.

In the last stage of rolling out the floating bridge, the desired turn-up of the outermost end of the bridgeway sheet 5 is thus achieved by means of the cables 19, to obtain the desired end termination.

What I claim is:

1. An inflatable floating bridge which can be rolled up or folded up when it is not inflated, comprising at least two inflatable hoses, arranged in generally parallel spaced relationship with each other, said hoses having means connectable to a source of gas under pressure for inflating said hoses and laying out the bridge, said hoses in an inflated condition constituting buoyant longitudinal side supporting means of the bridge, a sheet constituting a bridgeway extending between said hoses, each side edge portion of the sheet being joined in fluid-tight relationship to one of the hoses; a plurality of at least partially flexible load distributing means extending transversely across a major portion of said sheet, the distal ends of said load distributing means being spaced from said hoses along lines defining longitudinally extending marginal portions of said sheet adjacent said hoses; and longitudinally separated spacing means for separating the hoses so that, when a load is imposed on said sheet and said load distributing means, loaded portions of said sheet are depressed below the lower limits of said hoses with said marginal portions extending generally upwardly from said sheet to said hoses to form, with said sheet, a hull-like displacement volume for supporting the load.

2. A floating bridge according to claim 1, wherein said load distributing means comprise a plurality of mutually separated elongate load distributing elements attached to the bridgeway sheet and arranged transverse to the bridgeway and substantially uniformly distributed along the length of the bridgeway.

3. A floating bridge according to claim 2, wherein each of said load distributing elements is shorter than the distance between the longitudinal joining lines between the bridgeway sheet and the hoses, and wherein selected ones of said elements are displaced towards one side of the bridge and with one end of each being along the line defining one said marginal portion, and the remaining ones of said elements are correspondingly displaced towards the marginal portion along the other side of the bridge.

4. A floating bridge according to claim 2, wherein said load distributing elements are shorter than the distance between the longitudinal joint lines between the bridgeway sheet and the hoses, the end portions of the elements being made more yielding than the remainder thereof.

5. A floating bridge according to claim 2 wherein the outer ends of the load distributing elements are provided with surface increasing means comprising plates with a considerably larger maximum dimension than the width of the element.

6. A floating bridge according to claim 1 wherein each of the side supporting means and at least the adjacent portion of the bridgeway constitute portions of the same piece of sheet of which a rolled-in edge portion forms the respective hose and is sealingly united to the piece itself along the longitudinal joint line between the bridgeway and the respective hose.

7. A floating bridge according to claim 6 wherein said hoses, and the bridgeway sheet consist of an elastic material provided with reinforcing.

8. A floating bridge according to claim 1 and further comprising inner hoses of gas-tight material within the hoses comprising said side supporting means.

9. A floating bridge according to claim 1 wherein said load distributing elements consist of material resistant to bending, but partially flexible.

10. A floating bridge according to claim 1 wherein the rolling-out end of the bridge is provided with steering means whereby rolling out over water can be steered.

11. A floating bridge according to claim 10 wherein the rolling-out end of the bridge is provided with an end termination upstanding over the surface of the bridgeway, to prevent inflow of water onto the bridgeway from the end of the bridge.

12. An inflatable floating bridge which can be rolled up or folded up when it is not inflated, comprising at least two inflatable hoses, arranged in generally parallel spaced relationship with each other, their inflation resulting in laying out the bridge, said hoses in an inflated condition constituting the buoyant longitudinal side supporting means of the bridge, a sheet constituting a bridgeway extending between said hoses, each side edge portion of the sheet being joined in fluid-tight relationship to one of the hoses; a plurality of at least partially flexible load distributing means arranged on the sheet, with at least some of said load distributing means being connected to the hoses for load transmission; spacing means separating the hoses; and displacement increasing means comprising longitudinal ballast hoses fillable with water and arranged on the bridgeway sheet closely adjacent the side supporting hoses.

13. A floating bridge according to claim 12 wherein said displacement increasing means comprise elastic end portions of the load distributing means and portions of the bridgeway sheet adjacent to these end portions.

* * * * *